US006739009B2

(12) United States Patent
del Drago

(10) Patent No.: US 6,739,009 B2
(45) Date of Patent: May 25, 2004

(54) SUPPORTING DEVICE, NOTABLY MATTRESS, MATTRESS SUPPORT OR FOR A SEAT

(76) Inventor: Marcantonio del Drago, Obere Rainstrasse 7, Neuheim, CH-6345 (CH)

( * ) Notice: Subject to any disclaimer, the term of this patent is extended or adjusted under 35 U.S.C. 154(b) by 0 days.

(21) Appl. No.: 10/305,586

(22) Filed: Nov. 26, 2002

(65) Prior Publication Data

US 2003/0192126 A1 Oct. 16, 2003

Related U.S. Application Data

(63) Continuation of application No. PCT/CH01/00331, filed on May 28, 2001.

(51) Int. Cl.[7] ..... A47C 27/08

(52) U.S. Cl. ..... 5/713; 5/709; 5/714; 5/655.3; 5/914

(58) Field of Search ..... 5/689, 706, 709, 5/710, 713, 714, 644, 654, 655.3, 914, 665, 655.5

(56) References Cited

U.S. PATENT DOCUMENTS 2,434,641 A * 1/1948 Burns ..... 5/654 X
2,897,520 A * 8/1959 Bradford ..... 5/655.3 X
2,998,817 A * 9/1961 Armstrong ..... 5/713 X
3,605,145 A * 9/1971 Graebe ..... 5/706
3,653,083 A * 4/1972 Lapidus ..... 5/709 X
3,674,019 A * 7/1972 Grant ..... 5/713 X
3,778,851 A * 12/1973 Howorth ..... 5/714 X
3,879,776 A * 4/1975 Solen ..... 5/713 X
3,909,858 A * 10/1975 Ducker ..... 5/713
4,225,989 A * 10/1980 Corbett et al. ..... 5/713
4,347,633 A * 9/1982 Gammons et al. ..... 5/714 X
4,472,847 A * 9/1984 Gammons et al. ..... 5/714 X
4,646,373 A * 3/1987 Guldager ..... 5/706 X
4,688,283 A * 8/1987 Jacobson et al. ..... 5/709 X
4,827,546 A * 5/1989 Cvetkovic ..... 5/706 X
4,982,466 A * 1/1991 Higgins et al. ..... 5/713
4,995,124 A * 2/1991 Wridge, Jr. et al. ..... 5/709
5,142,717 A * 9/1992 Everard et al. ..... 5/709
5,243,722 A * 9/1993 Gusakov ..... 5/655.3
5,243,723 A * 9/1993 Cotner et al. ..... 5/714 X
5,304,271 A * 4/1994 Gusakov ..... 5/655.3 X
5,564,142 A * 10/1996 Liu ..... 5/689
5,634,224 A * 6/1997 Gates ..... 5/709
5,651,151 A * 7/1997 Schild ..... 5/713 X
5,685,036 A * 11/1997 Kopfstein et al. ..... 5/713
5,729,853 A * 3/1998 Thompson ..... 5/713
5,755,000 A * 5/1998 Thompson ..... 5/713
5,784,807 A * 7/1998 Pagel ..... 5/655.3 X
5,836,027 A * 11/1998 Leventhal et al. ..... 5/706
5,907,878 A * 6/1999 Thomas et al. ..... 5/706 X
5,918,336 A * 7/1999 Lee et al. ..... 5/713
6,148,461 A * 11/2000 Cook et al. ..... 5/713
6,212,719 B1 * 4/2001 Thomas et al. ..... 5/713
6,269,505 B1 * 8/2001 Wilkinson ..... 5/713
6,551,450 B1 * 4/2003 Thomas et al. ..... 5/713 X
6,564,411 B2 * 5/2003 Pirzada ..... 5/713
6,568,011 B2 * 5/2003 Fisher et al. ..... 5/706
6,588,038 B1 * 7/2003 Bondie et al. ..... 5/709

(List continued on next page.)

FOREIGN PATENT DOCUMENTS

FR 2 692 477 12/1993

*Primary Examiner*—Robert G. Santos
(74) *Attorney, Agent, or Firm*—Pearne & Gordon LLP

(57) ABSTRACT

Supporting device, notably mattress, mattress support or supporting device for seats, comprising several elements comprising flexible fluid-holding chambers aligned vertically and assembled in a network so as to form a structure enabling a body to rest. The pressure in each fluid-holding chamber is transmitted insider first conduits (4) coming out of said chamber. The first conduits communicate this pressure to the fluid-holding chambers of the neighboring elements.

23 Claims, 4 Drawing Sheets

U.S. PATENT DOCUMENTS

2001/0008029 A1 * 7/2001 Thomas et al. ..... 5/713
2002/0129448 A1 * 9/2002 Pirzada ..... 5/713
2003/0101516 A1 * 6/2003 Hsu et al. ..... 5/710
2003/0110565 A1 * 6/2003 Grabe ..... 5/644
2003/0121102 A1 * 7/2003 Brubaker et al. ..... 5/654
2003/0192126 A1 * 10/2003 del Drago ..... 5/713
2003/0200611 A1 * 10/2003 Chaffee ..... 5/710
2003/0208848 A1 * 11/2003 Flick et al. ..... 5/713
2003/0208849 A1 * 11/2003 Wilkinson ..... 5/713

* cited by examiner

SUPPORTING DEVICE, NOTABLY MATTRESS, MATTRESS SUPPORT OR FOR A SEAT

This application is a continuation of PCT application No. PCT/CH01/00331 filed May 28, 2001 under Swiss priority, the content of which is hereby incorporated.

FIELD OF THE INVENTION

The present invention concerns mattresses, mattress supports for beds or seats, comprising a group of fluid-holding chambers that communicate their pressure.

RELATED ART

In order to find a solution to the comfort inconveniences of traditional mattresses (latex, springs, foam) and of water mattresses, several constructions of fluid-holding beds have been attempted.

None meets fully the requirements of ease of assembly, advanced modularity, reduced space requirement, flexibility, hygiene and comfort.

It is an aim of the present invention to propose a mattress or mattress support for beds or seats that avoids the inconveniences of the prior art mattresses.

BRIEF SUMMARY OF THE INVENTION

According to the present invention, this aim is achieved in particular through the characteristics of the independent claims. Further advantageous embodiments are moreover described in the dependent claims and in the description.

In particular, this aim is achieved by means of a mattress or mattress support for beds or seats comprising a group of fluid-holding chambers that transmit their pressure.

DESCRIPTION OF THE DRAWINGS

The invention will be better understood by reading the description of a preferred embodiment given by way of example and illustrated by the attached drawings, in which.

DETAILED DESCRIPTION OF THE INVENTION

Figure 1:
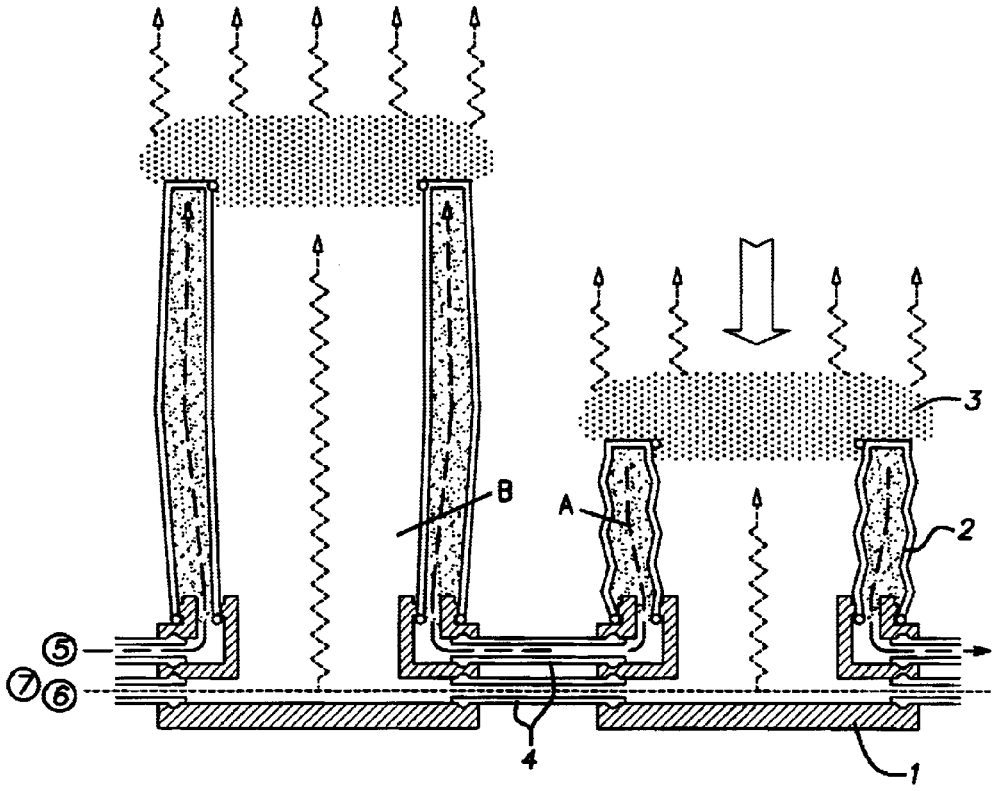
FIG. 1 shows a cross section of two elements of the network with a representation of the water and air-circuits.

FIG. 1 illustrates the principle of the invention.

The device of the invention consists of a group of elements whose arrangement in a grid network forms a supporting device, notably a mattress, mattress support or seating device. Each element is composed of a bloc (1), whose lateral sides have openings enabling it to communicate with neighboring elements by means of flexible conduits (4), and, on its upper part, of a double flexible wall forming a double vertical cylindrical chamber (2), shown here bulging and filled with a light foam in order to retain a vertical position by default whilst exerting a force that is barely perceptible by the body.

The device comprises first a fluids circuit (A), isolated from external pressure and supporting the weight of a body. An air stream (B) diffuses at the upper extremities of the chambers and is capable of being fed by a ventilation (5).

Figure 4:
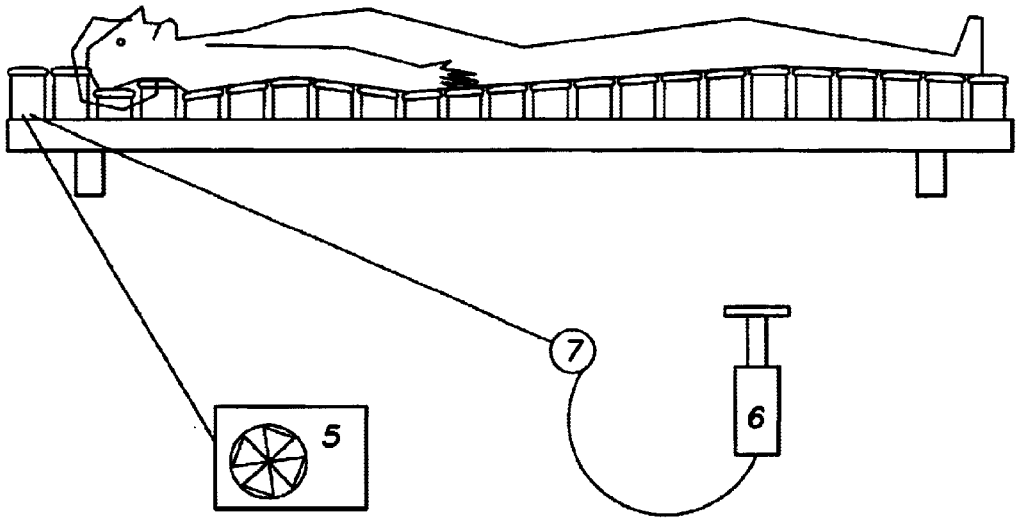
FIG. 4 shows a body resting on the device.

Each flexible chamber transmits a small part of the body's weight to the fluid contained in the chambers of the neighboring elements. The fluid is put under pressure and this force is transmitted further to the other chambers through the conduits, so as to enable the pressure to be spread without zones of peaks or hollows on the body, as shown in FIG. 4.

The epidermal compression is diminished by the use of a padding (3) very permeable to air and placed on the upper part of each element.

Comfort is further increased by the air stream whose temperature and intensity are controlled by an adaptable ventilation (5).

The fluid's initial pressure is regulated by a pump (6) by means of a gauge (7) so that the body sinks as much as possible into the network of elements, thus minimizing the epidermal compression.

Figure 2:
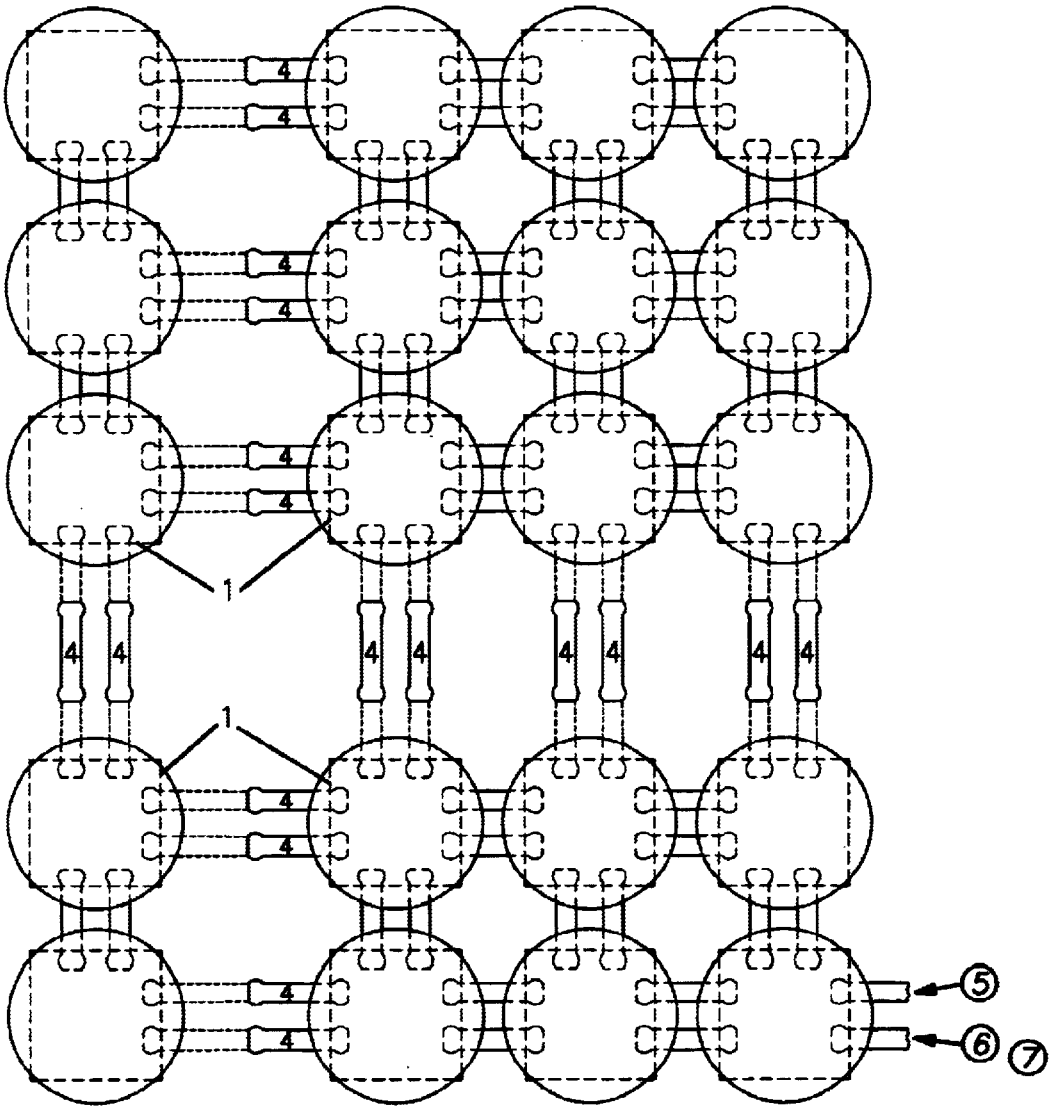
FIG. 2 shows the assembly of the device.

In order to simplify the description, the flexible conduits (4) have been superimposed in FIG. 1. In a variant embodiment of the invention, a better flexibility of adjustable mattresses or seat structures is achieved with juxtaposed flexible conduits as shown in FIG. 2.

It is also possible to conceive a double wall that can be folded in the manner of an accordion or of bellows, or that can be associated with a rigid and telescopic mechanism enabling a vertical guiding.

In another embodiment of the invention, air is used in the fluids circuit (A). If tightness to air or water is not an issue, it is possible to contemplate a communication between the two circuits. This solution enables the ventilator, air pump and gauge to be centralized.

The present invention has the following advantages:

1. Ease of assembly and modularity: the elements are assembled as indicated in FIG. 2, by putting together the blocs by means of the conduits (4). As illustrated in FIG. 2, each element, when placed on the sides or corners of the device, does not require any additional part to ensure the air or water tightness of its outer sides. If the network is used as a mattress, the dismantled device is lighter and requires less space than a traditional mattress of the same size. It can be disassembled and reassembled equally well on a bed of other dimensions as long as the available number of elements covers its surface. The flexible chambers require much less space than known jack solutions.

Figure 3:
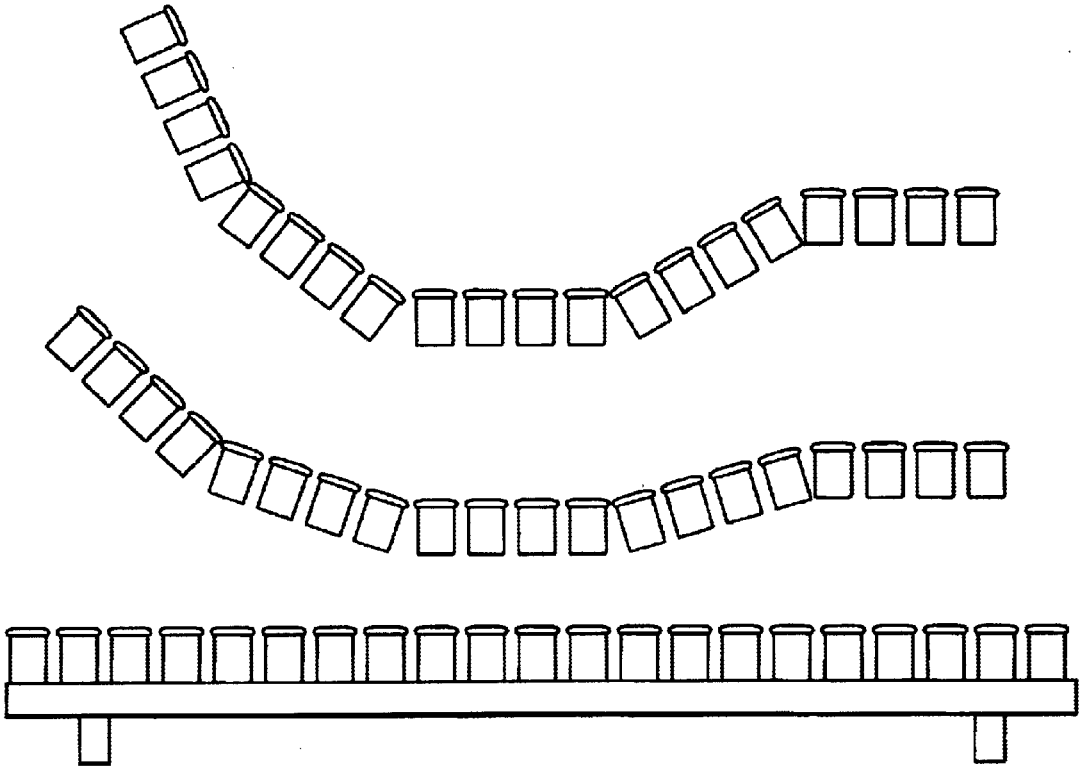
FIG. 3 illustrates the flexibility of the device.

2. Flexibility: the network's design makes it suitable for being used on adjustable mattress supports. FIG. 3 illustrates the profile of the mattress capable of adapting to an adjustable mattress support.

3. Hygiene and comfort: the air circulation at the upper extremities of the cylindrical chambers promotes the evaporation of any perspiration, which ensures a better respiration of the body parts in contact therewith. The possibility of modifying the temperature of the air circuit constitutes a certain advantage. Since it can be fully dismantled, the device can be entirely sterilized.

What is claimed is:

1. Supporting device, notably mattress, mattress support or supporting device for seats comprising several elements comprising flexible fluid-holding chambers aligned vertically along their respective longitudinal axes and assembled in a network so as to form a structure enabling a body to rest, the pressure in each fluid-holding chamber being transmitted inside first conduits coming out from said chamber, the first conduits communicating this pressure to the neighboring fluid-holding chambers, the fluid-holding chambers and the first conduits forming a fluids circuit, wherein an air stream independent from said fluids circuit acts on the upper extremity of each fluid-holding chamber meant to come into contact with the body.

2. The supporting device of claim 1, wherein said elements can be assembled and transported separately.

3. The supporting device of claim 1, wherein said first conduits come out from the base of said chambers and penetrate into the openings made in the walls of the neighboring chambers, so as to allow the pressure to spread without zones of peaks or hollows on the resting body.

4. The supporting device of claim 1, wherein said air stream is channeled inside the elements to come out on the upper extremity of each fluid-holding chamber.

5. The supporting device of claim 3, wherein a padding permeable to air is placed on the upper extremity of each fluid-holding chamber.

6. The supporting device of claim 1, wherein second conduits enable the air stream to pass from one element to another.

7. The supporting device of claim 1, wherein the pressure of the fluid inside the chambers is controlled and regulated by means of a pressure controlling and regulating device.

8. The supporting device of claim 1, comprising means for regulating the intensity and temperature of said air stream.

9. The supporting device of claim 1, wherein at least one of said fluid-holding chambers is filled with foam designed to ensure a vertical hold whatever the fluid's pressure.

10. The supporting device of claim 1, wherein at least one of said fluid-holding chambers comprise folds on their lateral sides designed to ensure a vertical hold and a folding possibility.

11. The supporting device of claim 1, wherein at least one wall of at least some of said fluid-holding chambers is coupled to a rigid and telescopic mechanism ensuring a vertical guiding of said chambers.

12. The supporting device of claim 1, wherein said first conduit is flexible.

13. The supporting device of one of the claims 1 to 3 and 4 to 12, further comprising means for ensuring the air and water tightness of its outer of at least one of said fluid-holding chambers when it is placed on a side or in a corner of said device, said means comprising no additional removable part.

14. The supporting device of claim 1, wherein said second conduit is flexible.

15. Element designed to be aligned vertically along a longitudinal axis thereof and assembled in a network so as to form a structure enabling a body to rest, comprising:

a vertically aligned flexible fluid-holding chamber, at least a first conduit coming out of said fluid-holding chamber and to which the pressure in said chamber is transmitted, an air circuit independent from said fluid-holding chamber and acting on the upper extremity of each fluid-holding chamber.

16. The element of claim 15, wherein said air circuit is channeled inside the element to come out on the upper extremity of each fluid-holding chamber.

17. The element of claim 16, wherein a padding permeable to air is placed on the upper extremity of said fluid-holding chamber.

18. The element of claim 15, comprising at least a second conduit enabling the air stream to pass to another element.

19. The element of claim 15, said fluid-holding chamber being at least partially filled with foam.

20. The element of claim 15, said fluid-holding chamber comprising folds on its lateral sides designed to ensure a vertical hold and a folding possibility.

21. The element of claim 15, at least one wall of said fluid-holding chamber being coupled to a rigid and telescopic mechanism ensuring a vertical guiding.

22. The element of claim 15, wherein said first conduit is flexible.

23. The supporting device of claim 18, wherein said second conduit is flexible.

* * * * *